US005617978A

United States Patent [19]

Geier

[11] Patent Number: 5,617,978

[45] Date of Patent: Apr. 8, 1997

[54] APPARATUS FOR DISPENSING A SEMIFLUID MEDIUM

[75] Inventor: Adalberto Geier, Lago, Italy

[73] Assignee: Coster Tecnologie Speciali S.p.A., Lago, Italy

[21] Appl. No.: 314,512

[22] Filed: Sep. 28, 1994

[51] Int. Cl.[6] ..... B65D 83/20

[52] U.S. Cl. ..... 222/402.13; 222/494; 222/153.06

[58] Field of Search ..... 222/402.1, 402.12, 222/402.13, 402.15, 494

[56] References Cited

U.S. PATENT DOCUMENTS

| | | | |
|---|---|---|---|
| 2,913,749 | 11/1959 | Ayres | 222/494 X |
| 3,203,454 | 8/1965 | Micallef | 222/402.12 X |
| 3,437,270 | 4/1969 | Venus, Jr. | 222/402.1 X |
| 3,545,682 | 12/1970 | Beard | 222/494 X |
| 3,602,407 | 8/1971 | Grothoff | 222/494 |
| 5,271,533 | 12/1993 | Joulia | 222/494 X |
| 5,305,930 | 4/1994 | De Laforcade | 222/402.13 |
| 5,340,031 | 8/1994 | Neuhaus et al. | 222/402.21 X |

FOREIGN PATENT DOCUMENTS

| | | | |
|---|---|---|---|
| 2654078 | 5/1991 | France | 222/494 |
| 94/16971 | 8/1994 | WIPO | 222/402.13 |

*Primary Examiner*—Andres Kashnikow
*Assistant Examiner*—Kenneth Bomberg
*Attorney, Agent, or Firm*—Knobbe, Martens, Olson & Bear, LLP.

[57] ABSTRACT

Apparatus for dispensing a semifluid medium, in particular a pasty mass such as cream, gel or the like, comprises a container with a dispensing valve. The dispensing valve comprises a delivery tube that can be displaced, for example into the interior of the container and/or tilted about its long axis, against the action of a resilient means such as a spring. The delivery tube is coupled to an actuator defining an annular channel in such a way that the annular channel is in fluid communication with the delivery tube. The annular channel is closed by an annular closure flap which when opened under the pressure of the medium contained in the container defines an annular gap through which the medium can be discharged.

29 Claims, 1 Drawing Sheet

APPARATUS FOR DISPENSING A SEMIFLUID MEDIUM

FIELD OF THE INVENTION

The present invention relates to an apparatus for dispensing a semifluid medium, such as a pasty or highly viscous mass, cream or gel, from a container. In particular, the invention relates to a dispensing apparatus comprising a container with a dispensing valve having a delivery tube that can be displaced into the interior of the container and/or tilted about its long axis, against the action of an elastic element.

DESCRIPTION OF THE PRIOR ART

Such dispensing apparatus are known and in each case comprise a container defining an opening that can be closed by a lid. The lid also defines an opening, to which can be attached a dispensing valve. This construction is particularly familiar in connection with so-called aerosol cans.

SUMMARY OF THE INVENTION

The object of the present invention is to provide an improved design of dispensing apparatus with an actuator that comprises a discharge mechanism which assists the action of the user in wiping away the dispensed pasty mass.

According to the present invention there is provided apparatus for dispensing a semifluid medium from a container comprising a dispensing valve, a resilient means, a delivery tube that can be displaced against the action of the resilient means, an actuator defining an annular channel and to which the delivery tube can be coupled to place the annular channel in fluid communication with the delivery tube, and a closure flap for the annular channel which can be opened under the pressure of the medium contained in the container to define an annular gap through which the medium is discharged.

This construction allows the emerging medium to be wiped away from the annular gap by the user's finger conveniently, leaving no residue. In addition, it ensures that when the dispensing valve is closed, medium present in the actuator is hermetically sealed off from the surroundings by the closure flap. Accordingly, there is no premature oxidation of the medium that collects in the actuator after the first use of the apparatus. This is particularly the case when the closure flap is pretensioned toward its closed position.

An embodiment of the invention will now be described by way of example with reference to the accompanying drawings.

DESCRIPTION OF A PREFERRED EMBODIMENT

Figure 1:
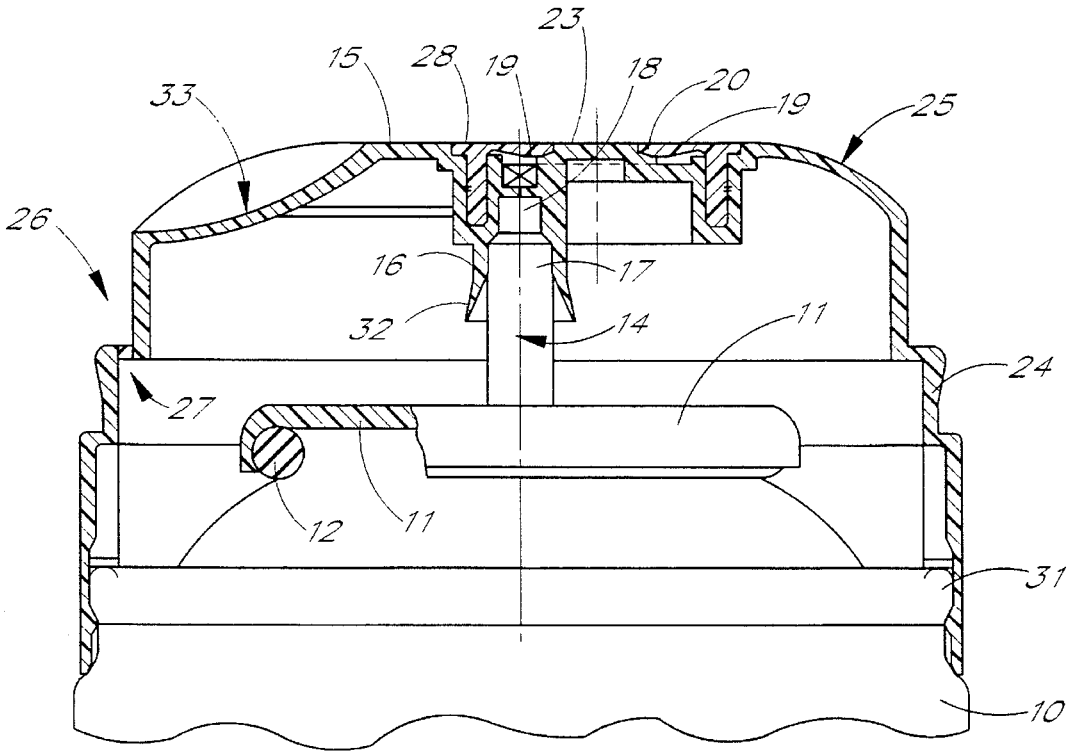
FIG. 1 is a longitudinal section, partly in side view, of the upper part of an apparatus according to the invention with a dispensing valve in a closed position.

As shown in FIG. 1, an apparatus for dispensing a semifluid medium, in particular a cream, gel or the like, comprises a can-like container 10, an upper opening of which is closed in a fluid-tight manner by a lid 11. To make it leakproof, an O-ring seal 12 is disposed between the upper rim of the container opening and the edge of the lid. In the lid 11 an opening is likewise provided, at the margin of which a dispensing valve is attached in a fluid-tight manner. This dispensing valve comprises a delivery tube 14 that can be displaced toward the interior of the container and/or tilted about its long axis 13 against the action of a resilient means, in particular a compression coil spring. The delivery tube 14 projects outward above the lid 11. This valve construction is generally known, in particular in association with so-called aerosol cans, so that it need not be described in detail here.

Figure 2:
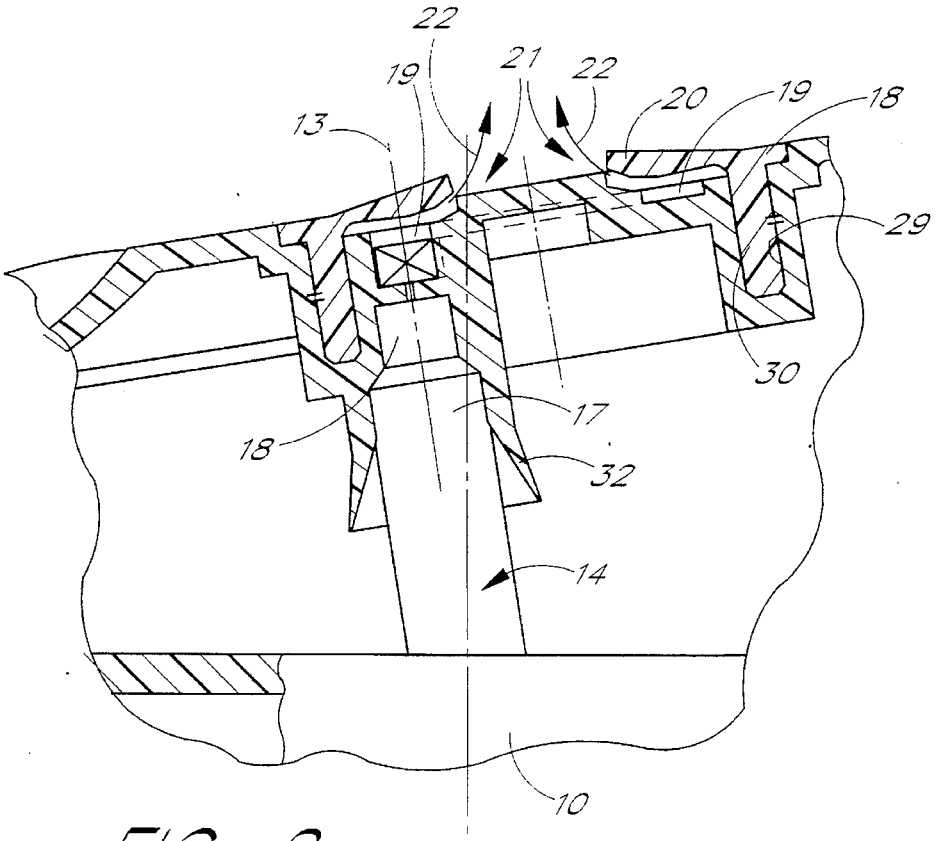
FIG. 2 is and enlarged view of part of the apparatus shown in FIG. 1 but with the dispensing valve in an open position.

The delivery tube 14 is coupled to an actuator in the form of an actuating key 15. For this purpose, on the inner surface of the actuating key 15, which faces toward the delivery tube 14, a pot-like receptacle 16 for the discharge end 17 of the delivery tube 14 is formed, preferably by being molded integrally therewith so that it encloses the discharge end 17 of the delivery tube 14 tightly enough to be leakproof. The interior space 18 of the pot-like receptacle 16 is in fluid communication with an annular channel 19 formed in the outer surface of the actuating key 15, i.e. the surface facing away from the container 10. The annular channel 19 is associated with a correspondingly annular closure flap 20, which defines an annular gap 21 through which the medium is discharged when the dispenser valve opens under the pressure of the container contents. Discharge of the medium through the slit opening 21 is represented by the arrows 22 in FIG. 2. In the closed position, the central region 23 delimited by the annular closure flap 20 and the annular closure flap 20 itself together form a continuous, smooth surface. The closure flap in the closed position is flush with the central region 23. The annular closure flap 20 is preferably pretensioned toward the closed position, to ensure that when the apparatus is not in use the medium within the interior space 18 and annular channel 19 is hermetically sealed off from the external surroundings. Although in the illustrated embodiment the annular closure flap 19 together with the central region 23 defines a flat, planar surface, this surface can instead be either slightly convex or slightly concave.

The actuating key 15 is part of a container cap 24. At one end 25 it is integral with the container cap 24 and at its other end 26, diametric relative to the delivery tube 14 and the annular closure flap 20, it is connected to the container cap by way of a guarantee break-point in the form of frangible strips 27.

The annular closure flap 20 is part of a separate component 28 that is attached to the actuating key 15 in an adjacent position corresponding to the annular channel 19. For this purpose there is formed in the outer surface of the actuating key 15 a groove 29 encircling the annular channel 19, into which is force fitted a complementary annular projection 30 of the component 28 that bears the closure flap 20.

The container cap 24 comprising the actuating key 15 can be set onto the circumferential edge 31 of the cylindrical container 10 so that it encloses the latter with a clamping action and simultaneously receives the delivery tube 14 within the pot-like receptacle 16 on the inner surface of the actuating key 15, which faces toward the container 10. The inner circumferential edge 32 of the receptacle 16 for the delivery tube 14 or its discharge end 17, i.e. the edge directed toward the delivery tube 14, is flared, expanding outward in a conical or trumpetlike shape. This measure facilitates assembly of the container cap 24 in such a way that the delivery tube 14 is properly seated.

The actuating key 15, at its end 26 toward the frangible strips 27 also incorporates a press-key in the form of an indentation 33.

What is claimed is:

1. Apparatus for dispensing a semifluid medium comprising a container for said medium having an upper portion including a delivery tube for fluid communication between the interior of the container and the exterior of the container, a dispensing valve to control the flow of the medium through the delivery tube, an actuator for actuation of the valve, having an upper surface having a circular opening therein with a circular portion of said surface in the center of the opening to form an annular outlet in the surface for the medium, and a flexible annular closure flap disposed in the outlet, the flap being movable between a closed position sealing the annular outlet and an open position, said flap being sufficiently flexible so that when the valve is actuated by the actuator and the delivery tube is thereby placed in fluid communication with the outlet, the flap can be opened by the pressure of the medium in the container, the closure flap in the closed position and the upper surface of the actuator together defining a continuous flush, smooth surface, such that, in use, residual medium left on the flush surface can be wiped off, leaving substantially no residue thereon.

2. Apparatus as claimed in claim 1, wherein the actuator forms part of a cap for the container.

3. Apparatus as claimed in claim 2, wherein a portion of the boundary between the actuator and the remainder of the container cap comprises a frangible means.

4. Apparatus as claimed in claim 3, wherein a portion of the actuator adjacent to the frangible means comprises an indented press-key.

5. Apparatus as claimed in claim 2, wherein the cap comprising the actuator is configured to clamp onto a circumferential edge of the container.

6. Apparatus as claimed in claim 1, wherein the actuator has a lower surface defining a receptacle which engages the delivery tube in a fluid-tight manner.

7. Apparatus as claimed in claim 6, wherein an inner circumferential edge of the receptacle is flared radially outward.

8. Apparatus as claimed in claim 1, wherein the flush surface defined by the closure flap and the upper surface of the actuator is one of planar, convex or concave.

9. Apparatus as claimed in claim 1, wherein the closure flap is pretensioned toward its closed position.

10. Apparatus as claimed in claim 1, wherein the actuator defines an annular channel below the outlet in the surface for fluid communication with the delivery tube, and wherein the closure flap has a lower surface that covers the annular channel when the flap is in the closed position.

11. Apparatus as claimed in claim 10, wherein the actuator defines a groove which encircles the annular channel and into which a complementary annular projection provided on the closure flap is fitted.

12. A cap for a container for dispensing a semifluid medium, comprising an actuator for actuating the dispensing of the medium, having an upper surface having a circular opening therein with a circular portion of said surface in the center of the opening, to form an annular outlet in the surface for the medium, and a flexible annular closure flap disposed in the opening, the flap being movable between a closed position sealing the annular outlet and an open position to permit discharge of the medium when the cap is attached to the container and the actuator is actuated, the closure flap in the closed position and the upper surface of the actuator together defining a continuous flush, smooth surface, such that, in use, residual medium left on the flush surface can be wiped off, leaving substantially no residue thereon.

13. Apparatus as claimed in claim 12, wherein the actuator defines an annular channel below the outlet for fluid communication with the interior of the container, and wherein the closure flap has a lower surface that covers the annular channel when the flap is in the closed position.

14. Apparatus as claimed in 13, wherein the actuator defines a groove which encircles the annular channel and into which a complementary annular projection provided on the closure flap is fitted.

15. Apparatus for dispensing a semifluid medium from a container of the type having a delivery tube in fluid communication between the interior of the container and the exterior of the container and a dispensing value to control the flow of the medium through the delivery tube, said dispensing apparatus comprising an actuator having upper and lower surfaces, the upper surface defining inner and outer concentric annular channels, the lower surface being configured to engage the delivery tube to place the delivery tube in fluid communication with the inner annular channel, and a closure member having a downwardly-extending annular projection and a flexible, inwardly-extending closure flap, the annular projection being configured to fit securely within the outer annular channel, the closure flap being movable between a closed position covering the inner annular channel and an open position defining an annular gap through which the medium is discharged upon activation of the valve.

16. Apparatus as claimed in claim 15, wherein the actuator forms part of a cap for the container and comprises means to actuate the valve.

17. Apparatus as claimed in claim 16, wherein the cap comprising the actuator is configured to clamp onto a circumferential edge of the container.

18. Apparatus as claimed in claim 15, wherein the lower surface of the actuator defines a receptacle which engages the delivery tube in a fluid-tight manner and which is in fluid communication with the inner annular channel.

19. Apparatus as claimed in claim 18, wherein an inner circumferential edge of the receptacle is flared radially outward.

20. Apparatus as claimed in claim 15, wherein the closure flap in the closed position and the upper surface of the actuator together define a continuous flush smooth surface, such that any residual medium left on the flush surface can be wiped off, leaving substantially no residue.

21. Apparatus as claimed in claim 20, wherein the flush surface defined by the closure flap and the upper surface of the actuator is one of planar, convex or concave.

22. Apparatus for dispensing a semifluid medium from a container of the type having a delivery tube in fluid communication between the interior of the container and the exterior of the container and a dispensing valve to control the flow of the medium through the delivery tube, said dispensing apparatus comprising an actuator having an upper and a lower surface, the upper surface defining an annular recess in which is formed an annular groove, the lower surface being configured to engage the delivery tube to place the annular groove in fluid communication with the delivery tube, and a flexible closure flap disposed on the upper surface of the actuator, the flap being movable between a closed position covering the annular groove and an open position defining an annular gap through which the medium is discharged upon activation of the valve, the closure flap in the closed position and the upper surface of the actuator together defining a continuous flush smooth surface, such that any residual medium left on the flush surface can be wiped off, leaving substantially no residue.

23. Apparatus as claimed in claim 22, wherein the actuator forms part of a cap for the container and comprises means to actuate the valve.

24. Apparatus as claimed in claim 23, wherein the cap comprising the actuator is configured to clamp onto a circumferential edge of the container.

25. Apparatus as claimed in claim 22, wherein the lower surface of the actuator defines a receptacle which engages the delivery tube in a fluid-tight manner and which is in fluid communication with the annular groove.

26. Apparatus as claimed in claim 25, wherein an inner circumferential edge of the receptacle is flared radially outward.

27. Apparatus as claimed in claim 22, wherein the closure flap forms part of a component which is attached to the actuator in a position adjacent to the annular recess.

28. Apparatus as claimed in claim 27, wherein the upper surface of the actuator defines a second groove which encircles the annular recess and into which a complementary annular projection provided on said component can be fitted.

29. Apparatus as claimed in claim 25, wherein the flush surface defined by the closure flap and the upper surface of the actuator is one of planar, convex or concave.

* * * * *

UNITED STATES PATENT AND TRADEMARK OFFICE

CERTIFICATE OF CORRECTION

PATENT NO. : 5,617,978
DATED : April 8, 1997
INVENTOR(S) : Adalberto Geier

It is certified that error appears in the above-identified patent and that said Letters Patent is hereby corrected as shown below:

Column 4,
Line 19, which reads "value", should read -- valve --.

Signed and Sealed this

Twenty-fourth Day of September, 2002

*Attest:*

*Attesting Officer*

JAMES E. ROGAN
*Director of the United States Patent and Trademark Office*